US006405549B1

(12) United States Patent
Baffes

(10) Patent No.: US 6,405,549 B1
(45) **Date of Patent: *Jun. 18, 2002**

(54) PORTABLE HEATING UNIT USING A REFRIGERANT CIRCUIT MOVABLE WITHIN A ROOM

(75) Inventor: Peter Baffes, Skokie, IL (US)

(73) Assignee: DO Enterprises, LLC, Chicago, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/708,981

(22) Filed: Nov. 8, 2000

Related U.S. Application Data

(63) Continuation of application No. 09/497,956, filed on Feb. 4, 2000, now Pat. No. 6,167,714, which is a continuation of application No. 09/190,508, filed on Nov. 12, 1998, now abandoned.

(51) Int. Cl.[7] ..... F25D 19/02

(52) U.S. Cl. ..... 62/188; 62/324.1; 62/324.5; 62/448

(58) Field of Search ..... 62/324.1, 324.5, 62/323.1, 188, 288, 448, 196.4; 237/2 B

(56) References Cited

U.S. PATENT DOCUMENTS

| | | | | |
|---|---|---|---|---|
| 3,496,731 | A | * | 2/1970 | Sholtes |
| 3,777,506 | A | | 12/1973 | Hergatt et al. |
| 4,441,335 | A | | 4/1984 | Bonne |
| 4,450,900 | A | | 5/1984 | Nathan |

(List continued on next page.)

FOREIGN PATENT DOCUMENTS

| | | | |
|---|---|---|---|
| EP | 0718564 A2 | * | 6/1996 |
| JP | 62056719 A | * | 3/1987 |

OTHER PUBLICATIONS

OceanAire, Inc., Engineereing, Installation and Service Manual, Aug. 1, 1998.
OceanAire, AirBoss advertising sheet, undated—admitted prior art.
Heat Exchangers, Inc., Koldwave Engineering Installation & Service Manual, undated—admitted prior art.
Air Rover, downloaded pages from internet website, undated—admitted prior art.

(List continued on next page.)

*Primary Examiner*—Chen-Wen Jiang
(74) *Attorney, Agent, or Firm*—Rockey, Milnamow & Katz,Ltd.

(57) ABSTRACT

A portable heating and cooling unit intended to be used within a room or area of a building includes a cabinet supported on a plurality of wheels and a refrigeration circuit at least partially carried within said cabinet. The refrigeration circuit includes a first coil, a compressor, a second coil and a refrigerant reversing valve. In a cooling mode of operation, the first coil acts as an evaporator coil and room air is circulated by a first fan across the evaporator coil and delivered into the room. A second fan circulates room air through the second coil acting as a condenser coil and discharges the thus warmed air away from the room area to be cooled. In a heating mode of operation, the refrigerant reversing valve is activated to change the flow direction of the refrigerant through the circuit such that the first coil now acts as a condenser and The second coil now acts as the evaporator. Room air is drawn by the first fan across the first coil to heat the room air and delivery the room air into the area of the room to be heated. The second fan draws room air through the evaporator coil and discharges the thus cooled air away from the area of the room being cooled. The refrigerant reversing valve is activated by a control which is selectable to choose heating or cooling for the portable unit.

12 Claims, 3 Drawing Sheets

U.S. PATENT DOCUMENTS

| | | | | | |
|---|---|---|---|---|---|
| 4,745,770 | A | * | 5/1988 | Mintz | 62/324.1 X |
| 4,888,958 | A | | 12/1989 | Ella | |
| 4,901,538 | A | | 2/1990 | Anthony | |
| 5,031,690 | A | | 7/1991 | Anderson et al. | |
| 5,065,584 | A | * | 11/1991 | Byczynski et al. | 62/196.4 X |
| 5,097,672 | A | * | 3/1992 | Takenaka et al. | 62/186 |
| 5,184,475 | A | * | 2/1993 | Matsumi | 62/262 |
| 5,271,237 | A | * | 12/1993 | Popelka et al. | 62/188 |
| 5,533,357 | A | * | 7/1996 | Voorhis | 62/324.5 X |
| 5,729,985 | A | | 3/1998 | Yoshihara et al. | |
| 5,762,129 | A | | 6/1998 | Elliott | |
| 5,794,452 | A | | 8/1998 | Black et al. | |
| 6,167,714 | B1 | * | 1/2001 | Baffes | 62/188 |

OTHER PUBLICATIONS

The Applied Companies, downloaded pages from Internet website, Sep. 2, 1998.

The Avenger Series, downloaded pages from Internet website, Sep. 2, 1998.

Jainsons Aircon, downloaded pages from Internet website, Sep. 2, 1998.

Komfort Industries, Inc., downloaded pages from Internet website, Sep. 2, 1998.

Koldwave, downloaded pages from Internet website, Sep. 2, 1998.

Pinguino, downloaded pages from Internet website, Sep. 2, 1998.

Movincool Products, downloaded pages from Internet website, Sep. 2, 1998.

Ranco, pp. 28 through 35 technical manual, undated—admitted prior art.

Parker, Installation Instructions for Model A Constant Pressure Expansion Valve, undated—admitted prior art.

Micro Air Corporation, FX–Maxx Operations Manual, Jan. 2, 1998.

* cited by examiner

FIG. 1
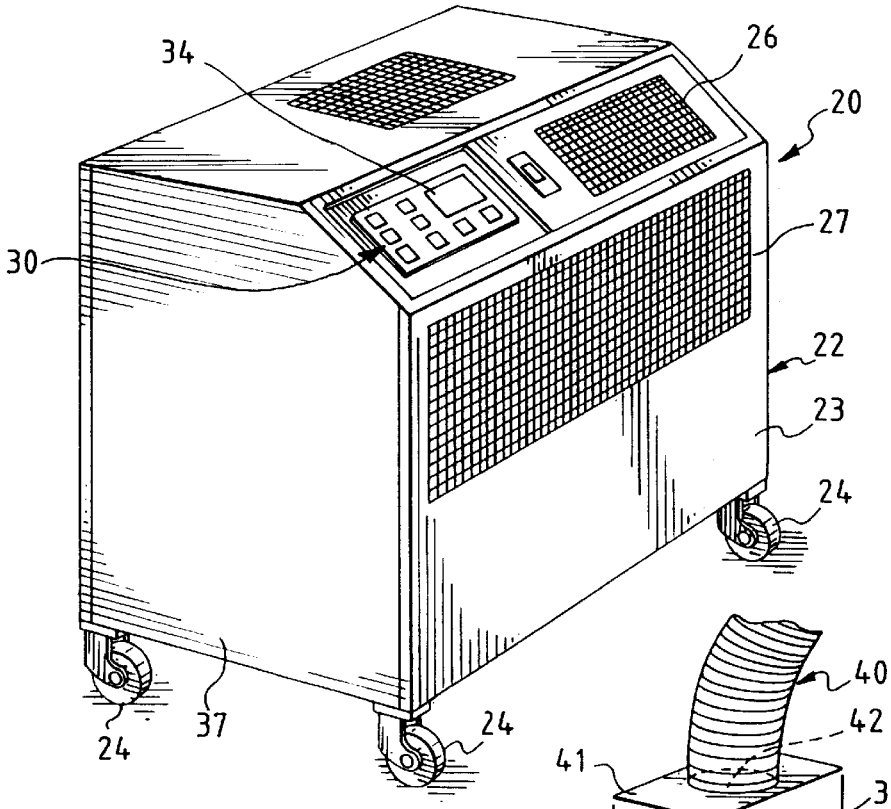
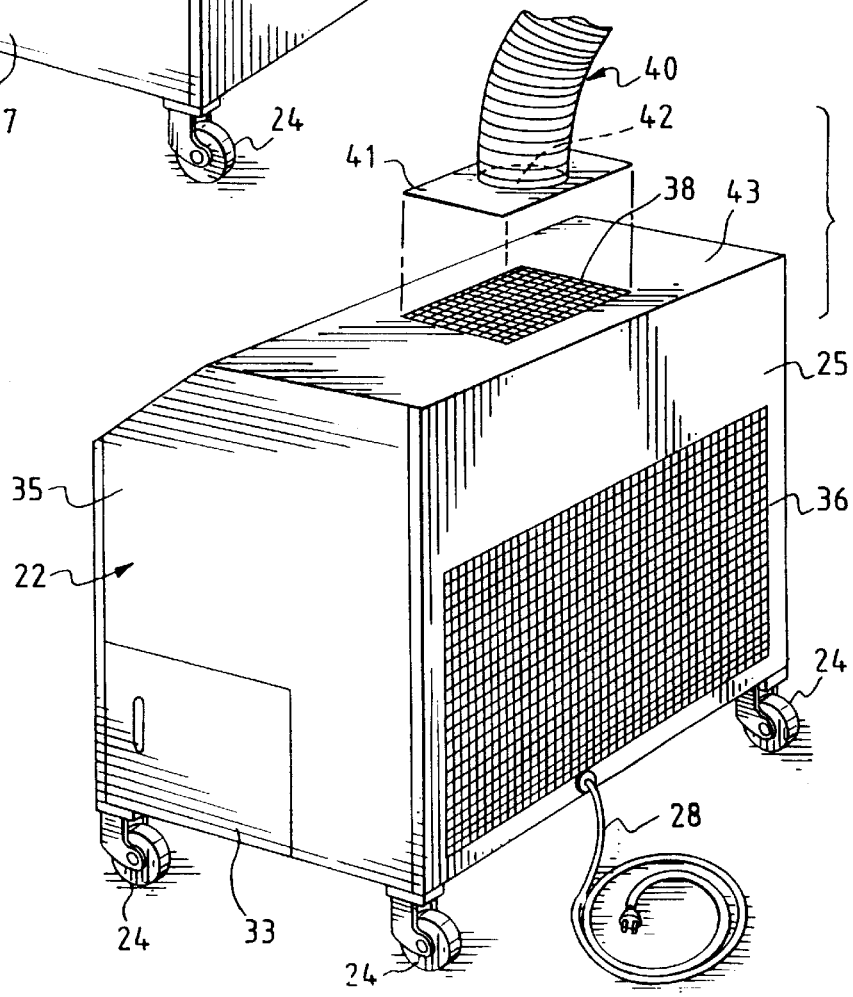
FIG. 2

PORTABLE HEATING UNIT USING A REFRIGERANT CIRCUIT MOVABLE WITHIN A ROOM

This is a continuation application of U.S. patent application Ser. No. 09/497,956, filed Feb. 4, 2000 (now U.S. Pat. No. 6,167,714), which is a continuation application of U.S. patent application Ser. No. 09/190,508, filed Nov. 12, 1998 (now abandoned), both of which are entitled PORTABLE COOLING AND HEATING UNIT USING REVERSIBLE REFRIGERANT CIRCUIT.

TECHNICAL FIELD OF THE INVENTION

The present invention relates to a portable heating and cooling unit for use in localized and temporary cooling and heating requirements in buildings, warehouses, computer rooms, and the like. Particularly, the present invention relates. to a portable heating and cooling unit using a refrigerant circuit, and which is mounted in a cabinet supported on wheels.

BACKGROUND OF THE INVENTION

Portable cooling units are known which are used in localized cooling and heating applications in office buildings, warehouses, computer rooms and the like. The portable cooling units are held within a cabinet which in turn is mounted on caster wheels for mobility. The cooling unit can be placed in near proximity to a particular location which is otherwise not adequately served by the central cooling system of the building or other enclosure. The portable cooling unit can be used to economize on cooling supply in a large structure if only small areas need precise cooling control or extra cooling capacity.

Portable cooling units are useful in localized cooling within a room. The cooling units include a refrigeration circuit which typically includes an evaporator coil, a compressor, a condenser coil and a pressure reducing or expansion valve in a closed circuit containing Freon or other suitable refrigerant. During cooling operation, such a cooling unit draws a first stream of room air past the evaporator coil to cool the air, and passes the thus cooled air back into the room. The cooling unit also draws in a second stream of room air across the condenser coil to condense the refrigerant therein. During condensing of the refrigerant, the second stream of room air is heated and the thus warmed air is directed away from the room area being cooled such as via an exhaust duct. In some cases the warmed air can be discharged simply in a direction away from the cabinet away from the area to be cooled, or can be ducted to the central cooling system return air supply, or to outside of the building.

In some portable cooling units, an electric heating circuit is provided for those occasions when extra heating capacity, rather than cooling capacity, is needed. The heating circuit typically consists of an electric resistance coil wherein a fan circulates room air across the coil to heat the air and pass the air back into the room.

SUMMARY OF THE INVENTION

The present invention contemplates a portable cooling and heating unit which includes a reversible refrigerant circuit to alternately provide either cool air or warm air to a room or area of a building. The portable unit includes a cabinet which houses a refrigerant circuit including a first coil and a second coil, a compressor, and valving and accessories to complete the refrigerant circuit. The first coil and the second coil can each alternately serve as evaporator or condenser, depending on whether the unit is being used for heating or cooling. The cabinet also houses fans for drawing room air into the cabinet to be heated or cooled by the first coil and returned to the room, and for drawing room air (heat exchange air) into the cabinet for causing either evaporation or condensing of the refrigerant in the second coil wherein the thus cooled or warm room air is ducted away (or directed away) from the area being cooled or heated.

The cabinet is mounted on caster wheels to be portable within a building or other structure. The discharged heat exchange air, either warm air or cool air, can be ducted by a flexible duct to outside of the room being heated or cooled.

In contrast to prior known portable cooling units, the present invention includes a reversible refrigerant circuit for alternately cooling or heating room air. The refrigerant circuit has a refrigerant flow reversing valve that can be selectively switched to change the unit service from cooling to heating, and the reverse. By reversing the refrigerant's flow, the first coil and the second coil effectively switch services from evaporator to condenser, or vice versa. By reversing the services of the first and second coils during a switch from cooling to heating service, or vice versa, the first coil can always serve as the room air treating coil while the second coil can always serve as the heat exchange air coil. In this regard, the discharged heat exchange air from the second coil can be ducted away from the area served by a single duct for both alternate heating and cooling periods. Neither the cabinet or the duct need be reversed or reducted for alternate heating or cooling periods.

One or more condensate drip pans are arranged below both the first and second coils. Although a single drip pan can be located below both coils, preferably one drip pan is located below each coil. In accordance with the preferred embodiment cabinet arrangement, the first coil, which serves for alternately heating or cooling room air to be delivered into the room, has a first drip pan which is elevated from a condensate collection tank, and any condensate collected in the first drip pan drains by gravity into the condensate collection tank. A second drip pan for the second coil is arranged at a position lower than the condensate collection tank. A condensate pump is provided in the second drip pan located below the second coil to pump condensate into the condensate collection tank from the second drip pan.

The condensate collection tank can include an automatic shut off system wherein, when the condensate level reaches a maximum in the collection tank, the refrigeration circuit is shut down. The condensate collection tank can be drained continuously by a hose connection to a room drain, or can be drained intermittently by manual drain, for example, by removal of the condensate collection tank and draining of the condensate collected therein. The first coil will typically generate condensate during a cooling operation of the unit, while the second coil will generate condensate during a heating operation of the unit.

According to the invention, an electrical resistance heater is no longer required for the alternate heating mode of the portable heating and cooling unit. The portable heating and cooling unit can thus be efficiently operated as a cooler or a heater by manually reversing the refrigerant circuit. The portable heating and cooling unit is a compact and portable apparatus which effectively heats and cools localized areas within a building, warehouse, computer room and the like. It can be quickly changed in operation from cooling to heating by controls applied onto a front surface of the cabinet. Condensate produced during either a heating or cooling operation is effectively contained within one or more drip pans, and stored in a condensate collection tank for continuous or intermittent disposal.

Numerous other advantages and features of the present invention will become readily apparent from the following detailed description of the invention and the embodiments thereof, from the claims and from the accompanying drawings.

BRIEF DESCRIPTION OF THE DRAWINGS

FIG. 1 is a front perspective view of a portable heating and cooling unit of the present invention;

FIG. 2 is a rear perspective view of the portable heating and cooling unit of FIG. 1;

DETAILED DESCRIPTION OF THE PREFERRED EMBODIMENTS

Figure 3:
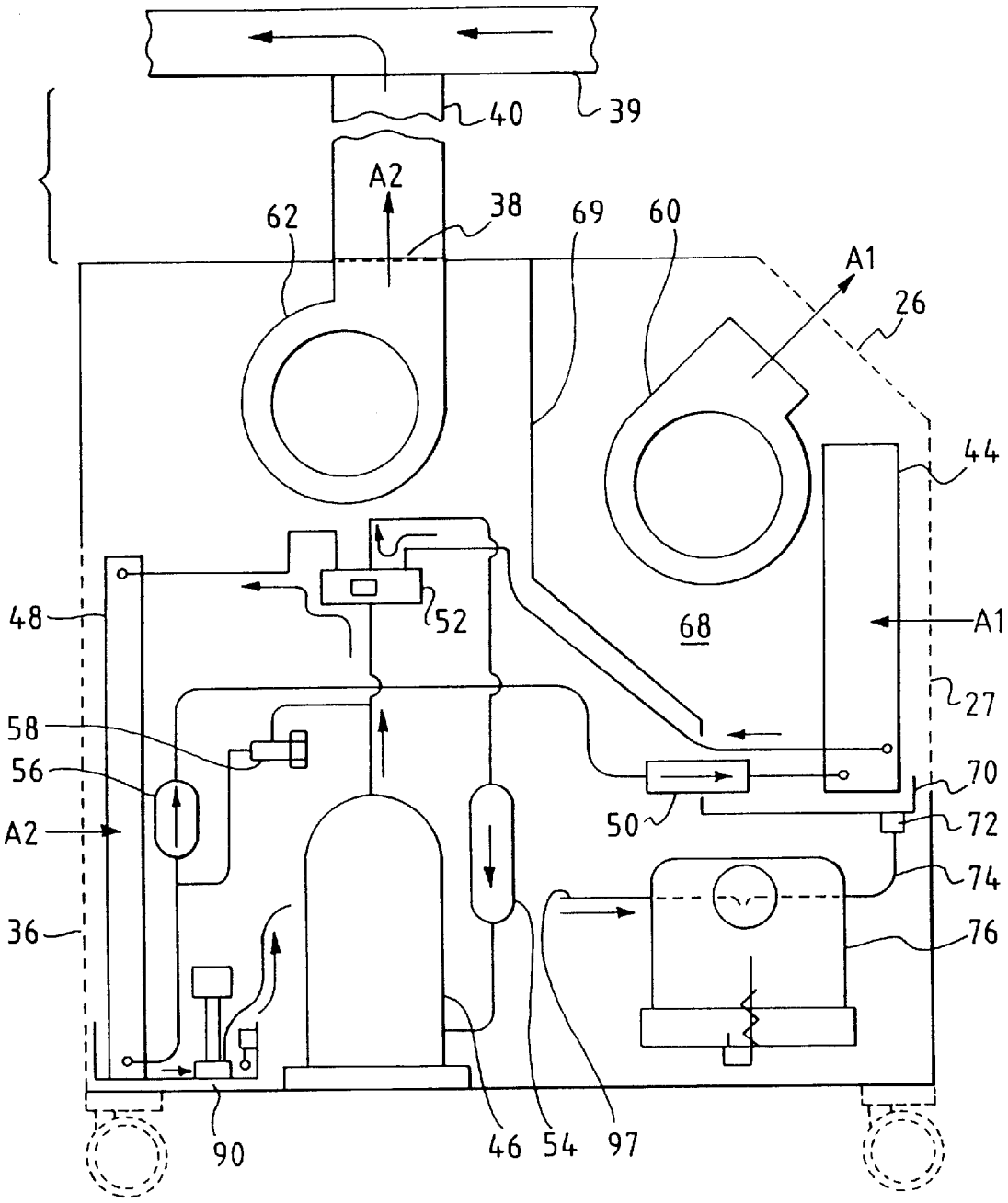
FIG. 3 is a schematic layout of the portable heating and cooling unit of the present invention, in a cooling mode of operation.

While this invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

FIGS. 1 and 2 illustrate a portable heating and cooling unit 20 of the present invention. The unit includes a cabinet 22 mounted on four caster wheels 24. The cabinet 22 includes a front panel 23, a rear panel 25, and two side panels 35, 37. Either or both of the side panels 35, 37 are removable to perform maintenance or service on the unit 20. The cabinet includes a room delivery air outlet grille 26 angled upwardly on a front side of the cabinet. The unit also includes a delivery air inlet grille 27 on a front side of the cabinet. A power cord 28 is provided for connecting the unit to a source of electrical power. A condensate tank access door 33 is provided on the side panel 35 of the cabinet.

The unit includes a control 30 which incorporates an electronic thermostat 34 and associated displays and selectable controls. The control 30 can be, for example, a MICRO AIR, Model FX Maxx controller, supplied by Micro Air Corporation of Allentown, N.J. This control allows for both automatic and manual operation of both refrigeration circuits and fan equipment. The control can provide for automatic switching between cooling and heating modes. Room temperature and moisture can be monitored and the unit operated accordingly.

On a back side of the cabinet 22 is a heat exchange air inlet grille 36 for drawing heat exchange air into the cabinet 22. A heat exchange air outlet 38 is located on a top side of the cabinet and can be connected to a flexible duct 40 for exhausting heat exchange air to a position outside of the room being heated or cooled. The duct 40 can be connected to an air-to-outside vent through a wall or window, or connected to a return air duct 39 of the building central heating and cooling system, typically an overhead duct as shown in FIG. 3. A plate or plenum 41 restraining an open end 42 of the duct 40 can be fastened to a top panel 43 of the cabinet 22. The open end 42 of the duct would be in registry with the air outlet 38. Plenums, ducts, nozzles and other air handling convenience items can also be added.

FIG. 3 illustrates in schematic fashion the components of the heating and cooling unit 20 of the invention. FIG. 3 illustrates the unit 20 in a cooling mode of operation. A refrigerant circuit includes a first coil 44, a compressor 46, a second coil 48, a bidirectional, fixed orifice refrigerant flow control 50, and a refrigerant flow reversing valve 52. A compressor accumulator 54, a bi-directional refrigerant dryer 56, and a hot gas bypass regulator 58 are also included in the refrigerant circuit, The refrigerant circuit is charged with a refrigerant such as R22 refrigerant.

Air handling equipment includes a room air delivery fan 60 and a heat exchange air fan 62. The room air delivery fan 60 draws air A1 through the air delivery inlet grille 27, across the first coil 44 and through the air delivery outlet grille 26 and into the room.

The exhaust fan 62 draws air A2 through the heat exchange air inlet grille 36, across the second coil 48, and through the heat exchange outlet 38, through the duct 40 and to a position outside of the room or at least away from the air stream A1.

In the cooling mode of operation, the refrigerant flow circulates in the tubing as per the arrows shown in FIG. 3. The first coil 44 serves as an evaporator coil, evaporating the refrigerant by removing heat from the room air A1 passing across the coil 44 and thus cooling the room air which passes through the inlet grille 27 and out of the delivery outlet grille 26 and into the room.

The second coil 48 serves as a condenser coil, and air A2 drawn through the second coil by the exhaust fan 62 is heated as a refrigerant is condensed within the coil 48. During this cooling operation, condensate may form on the evaporator coil 44, and within a chamber 68 which is in contact with the air A1, from moisture contained in the room air. This condensate is collected in a first condensate drip pan 70. A chamber drip deflector 69 directs condensate to the first drip pan 70. Condensate from the coil 44 falls by gravity into the pan 70. The drip pan 70 includes a gravity drain 72 and a drain line 74 which feeds into a condensate collection tank 76.

The condensate collection tank 76 can be designed for hand removal, through the access door 33 (shown in FIG. 2), for periodic draining, or can have a drainage hose connected thereto for continuous draining. The collection tank 76 includes an automatic switch 77 which deactivates the unit 20 when condensate level in the tank 76 is at a preselected maximum condensate level. As an alternative, a condensate pump can replace the tank 76, the condensate pump receiving condensate from the drip pan 70 and pumping the condensate to a discharge location at a distance from the unit 20. The compressor 46 is then shut off, shutting down the refrigerant circuit. The fans 60, 62 can be shut down also.

Figure 4:
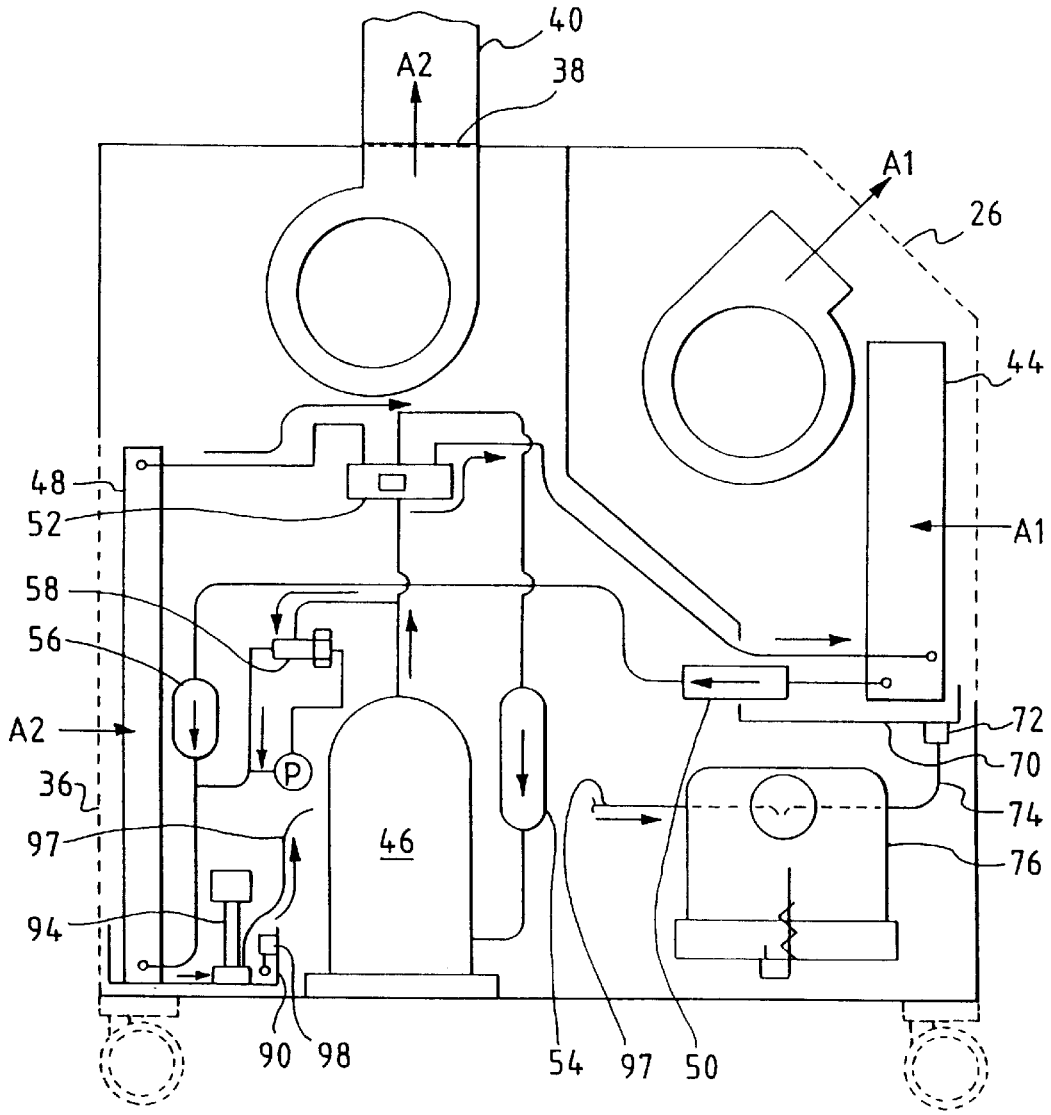
FIG. 4 is a schematic layout of the portable heating and cooling unit of the present invention, in a heating mode of operation.

During a heating operation as shown in FIG. 4, the first coil 44 serves as a condenser, and the second coil 48 serves as the evaporator. The flow of refrigerant is reversed by operation of the refrigerant flow reversing valve 52. Air A1 passing through the first coil 44 is heated, and thus warm air is delivered to the room from the delivery outlet grille 26. Air A2 passing through the second coil 48 is cooled, delivering cool air out of the heat exchange air outlet 38 and through the duct 40 away from the air stream A1.

The reversal of the refrigerant reversing valve 52 is actuated by the control 30 either manually, or automatically based on room temperature. The reversing valve itself can be, for example, a RANCO reversing valve (3-way or 4-way pilot design) with a Ranco L-27 or L-30 solenoid coil.

It is possible that during heating mode of operation, especially when the unit is operated in a cold environment, that the temperature of the air A2 passing across the evaporator coil 48 is lowered to such an extent that condensed water vapor on the evaporator coil 48 is frozen on the coil. This reduces the overall efficiency of the unit by decreasing the heat transfer coefficient of the coil. To alleviate this problem, a controlled amount of hot gas can be bypassed by the hot gas bypass regulator 58 from the compressor 46 into an inlet of the evaporator coil 48, to prevent frosting by excessively low evaporator temperatures The hot gas bypass regulator can be a refrigerant pressure controlled valve, such as a PARKER Model A constant pressure expansion valve, supplied by Parker Hannifin Corporation of Longwood, Fla. This valve is normally spring-loaded closed. However, the spring is so arranged that if the outlet pressure of the valve drops below a preset pressure the valve will open. The regulator will, for example, maintain the R22 refrigerant pressure at 60 psig downstream of the regulator, entering the second coil 48.

This will maintain the evaporator at a sufficiently high temperature to avoid frosting on an outside of the second coil 48.

An alternate hot gas bypass system for defrosting which can be incorporated into the present refrigerant circuit is that disclosed in U.S. Pat. No. 5,794,452, herein incorporated by reference. In this patent hot gas from the compressor is periodically bypassed through a hot gas valve (16) to the system evaporators to remove ice (the "harvest" cycle for an ice maker). A harvest bypass valve (14) can be used to introduce an additional quantity of refrigerant into the compressor to insure sufficient refrigerant to carry out the harvest cycle within a predetermined time period. A periodic defrosting such as disclosed in U.S. Pat. No. 5,794,452 can also be incorporated in the present invention as well.

During the heating mode, with the second coil 48 serving as the evaporator, condensate can form on the second coil 48 and drip into a second drip pan 90. In the preferred compact arrangement of the cabinet 22, the second coil 48 is at a lower elevation than the condensate collection tank. Thus, a small pump 94 is provided in the condensate drip pan 90 to deliver the collected condensate via a tube 97 to the collection tank. The condensate pump 94 can be controlled for on and off operation depending on the condensate level collected within the second drip pan 90 by a float switch 98.

Although separate first and second drip pans 70, 90 are shown, a single drip pan could be arranged below both coils 44, 48. Also, the coil 48 could also be elevated above the condensate tank such that the second drip pan 90 could includes a gravity drain to the condensate collection tank, thus eliminating the condensate pump 94.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

The invention claimed is:

1. A portable heating unit movable within a room, comprising:

a cabinet sized to be movable within a room;

a refrigeration circuit carried within said cabinet, said circuit including a first coil, a refrigerant compressor, a second coil, and a reversing means, wherein said reversing means alternatively switches the operation of said first coil and said second coil between an evaporator coil and a condenser coil; and a first fan and a second fan, said first fan for passing a first room air stream across said first coil and returning the first room air stream to the room, and said second fan for passing a second room air stream across that second coil and delivering the second room air stream away from the room.

2. The portable heating unit according to claim 1, wherein said second fan is flow connected to an air outlet, and further comprising a duct connected to said air outlet at one end and connected to a space outside of the room at an opposite end thereof.

3. The portable heating unit according to claim 1, wherein said cabinet is supported on a plurality of caster wheels for rolling transport of said portable heating unit.

4. The portable heating unit according to claim 1, further comprising a condensate collection pan arranged beneath at least one of said first and second coils.

5. The portable heating unit according to claim 1, further comprising a first condensate collection pan arranged beneath said first coil, and a second condensate collection pan arranged beneath said second coil.

6. The portable heating unit according to claim 5, further comprising a condensate collection tank, and also further comprising a condensate pump having an inlet in flow communication with one of said first and second condensate collection pans and an outlet in flow communication with said condensate collection tank.

7. The portable heating unit according to claim 6, wherein said condensate collection tank includes an automatic refrigeration circuit shutoff which activates on high condensate level within said condensate collection tank to stop operation of said compressor.

8. The portable heating unit according to claim 1, wherein said cabinet includes a front side delivery air inlet and an upwardly angled air delivery outlet above said air inlet, and said first coil is arranged behind said air inlet, said first fan drawing air through said air inlet, through said first coil, and out of said angled air delivery outlet and into the room being heated [or cooled].

9. The portable heating unit according to claim 1, wherein said refrigeration circuit comprises a hot gas bypass regulator valve in flow communication with an outlet of said compressor and with an inlet of said evaporator coil, said regulator valve allowing a controlled amount of refrigerant gas from said compressor to enter said evaporator coil.

10. A portable heating unit for positioning inside a room of a building, comprising:

a cabinet mounted on a plurality of wheels;

a refrigeration circuit carried at least partially within said cabinet, and said refrigeration circuit including a first coil, a compressor, a second coil, a reversing means, wherein said reversing means alternatively switches the operation of said first coil and said second coil between an evaporator coil and a condenser coil, and a first fan for passing room air across said first coil and a second fan for passing room air across said second coil, said cabinet including an air delivery inlet in registry with said first coil and an air delivery outlet receiving air from said first fan and communicating the air into the room, and having a heat exchange air inlet on a backside of the cabinet in registry with the second coil and a heat exchange air outlet in flow communication with the second fan for delivering heat exchange air out of the cabinet.

11. A portable heating unit according to claim 10, further comprising a condensate drip pan arranged beneath said second coil.

12. A portable heating unit according to claim 11, further comprising a condensate tank mounted within said cabinet and a condensate pump having an inlet in flow communication with said drip pan and an outlet in flow communication with said condensate tank.

* * * * *